United States Patent [19]

Butscher

[11] 4,343,274

[45] Aug. 10, 1982

[54] INJECTION PUMP CONTROL ARRANGEMENT

[75] Inventor: Franz Butscher, Friedrichshafen, Fed. Rep. of Germany

[73] Assignee: MTU Motoren - und Turbinen-Union Friedrichshafen GmbH, Friedrichshafen, Fed. Rep. of Germany

[21] Appl. No.: 126,696

[22] Filed: Mar. 3, 1980

[30] Foreign Application Priority Data

Feb. 3, 1979 [DE] Fed. Rep. of Germany ..... 2908235

[51] Int. Cl.[3] ..... F02B 3/00

[52] U.S. Cl. ..... 123/357; 123/358; 123/359

[58] Field of Search ..... 123/357, 358, 359, 340, 123/349

[56] References Cited

U.S. PATENT DOCUMENTS

| | | | |
|---|---|---|---|
| 3,407,793 | 10/1968 | Lang | 123/357 |
| 3,695,242 | 10/1972 | Tada et al. | 123/357 |
| 3,757,750 | 9/1973 | Ohtani | 123/357 |
| 3,897,762 | 8/1975 | Jones et al. | 123/357 |
| 4,047,507 | 9/1977 | Noguchi et al. | 123/357 |
| 4,136,657 | 1/1979 | Tanaka et al. | 123/357 |
| 4,150,654 | 4/1979 | Heitzman etal. | 123/359 |
| 4,192,398 | 3/1980 | Hunt | 123/357 |
| 4,205,639 | 6/1980 | Kawake et al. | 123/358 |

*Primary Examiner*—Raymond A. Nelli

*Attorney, Agent, or Firm*—Craig and Antonelli

[57] ABSTRACT

A control arrangement for an injection pump of an internal combustion engine wherein a correcting element, determining the required power of the internal combustion engine, and a centrifugal speed governor, for maintaining the limiting speeds of the internal combustion engine, are effective on a control rod of the injection pump to adjust the required feed rate of the pump. A correcting displacement of the control rod is optionally limited by the control arrangement in dependence upon various influential variables of the internal combustion engine. The control arrangement includes an electromagnet which cooperates, under slight pretensioning, with a free end face of the control rod. An electronic circuit provided for processing an output signal of an inductive displacement pickup for the control rod position and signals defining the operating condition of the internal combustion engine to control a variable effecting a metered activation of the electromagnet.

8 Claims, 1 Drawing Figure

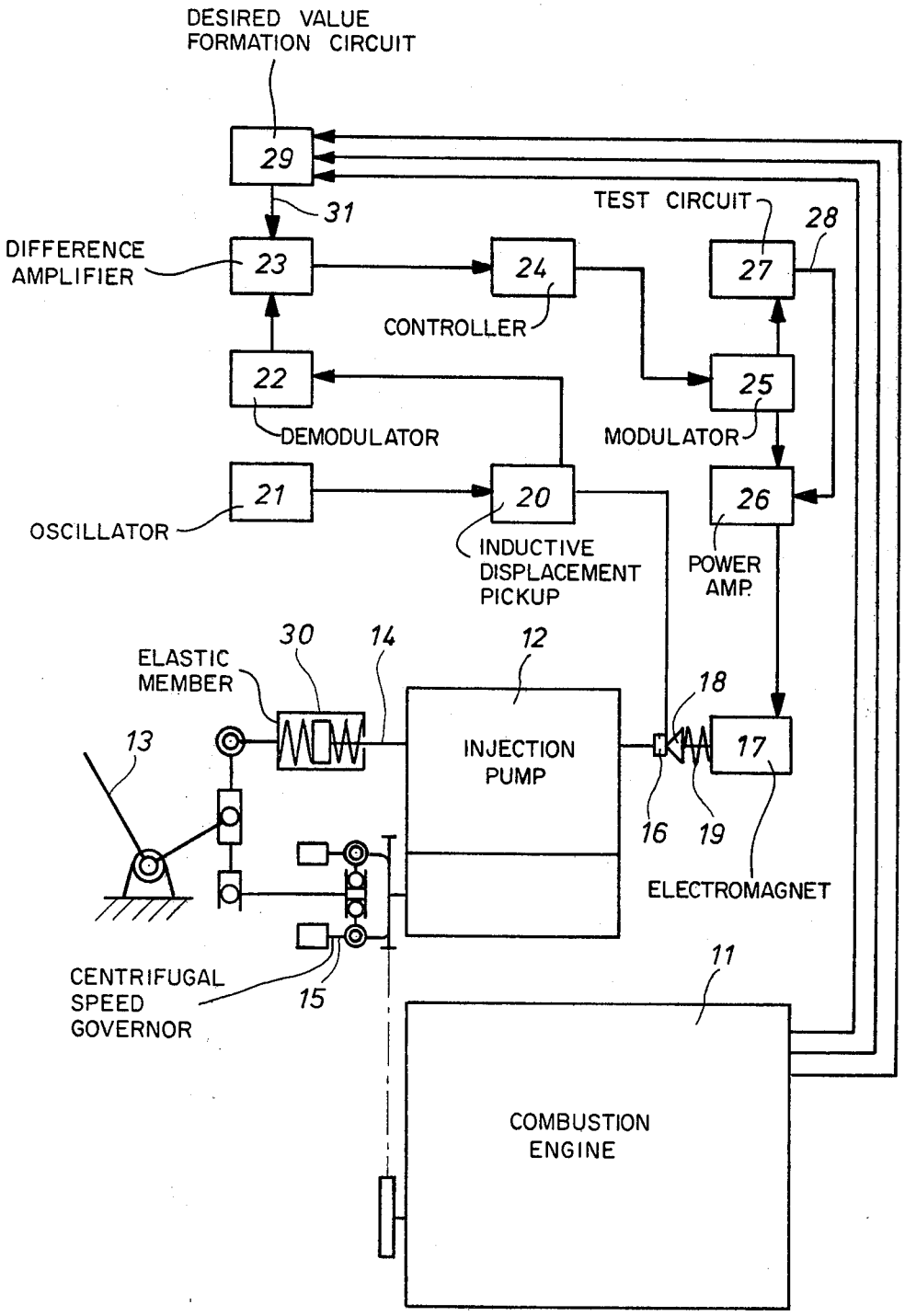
DESIRED VALUE FORMATION CIRCUIT
29
31
TEST CIRCUIT
28
DIFFERENCE AMPLIFIER
23
24
27
CONTROLLER
22
25
DEMODULATOR
MODULATOR
21
20
26
OSCILLATOR
INDUCTIVE DISPLACEMENT PICKUP
POWER AMP.
30
14
12
ELASTIC MEMBER
18
13
INJECTION PUMP
17
16
19
ELECTROMAGNET
11
CENTRIFUGAL SPEED GOVERNOR
15
COMBUSTION ENGINE

INJECTION PUMP CONTROL ARRANGEMENT

The present invention relates to a control arrangement for a fuel injection pump of an internal combustion engine and, more particularly, to a device for controlling or limiting a displacement of a control rod of the injection pump in dependence upon a number of influencing or actuating variables or operating characteristics of the internal combustion engine.

Control arrangement for fuel injection pumps of internal combustion engines have been proposed wherein a correcting means, provided for determining a required power of the internal combustion engine, and a centrifugal speed governor, provided for maintaining limiting speeds of the internal combustion engine, are both effective on the control rod of the injection pump so as to adjust a required feed rate of the pump. Optionally, a correcting displacement of the control rod may be limited in dependence upon operating characteristics of the engine.

A control arrangement of the aforementioned type has been proposed wherein a stop, movable by a stepping motor and helical gears, is provided for restricting a correcting displacement of the control rod or shifting of the control rod in a direction toward a reduction in the injected quantity of fuel by the fuel injection pump. The stepping motor controlling the correcting displacements of the movable stop is controlled by an electronic circuit in dependence upon operating variables of the internal combustion engine.

One disadvantage of the proposed construction resides in the fact that the helical gear exhibits a self-locking behavior thereby preventing the stop from automatically returning into a rest position. Thus, in case of an electrical failure or a defect in the electronic circuit, the stop is arrested or locked in the instantaneous position at which the failure or defect occurred thereby blocking the movement of the control rod of the fuel injection pump. As a result of the blocking of the control rod, a proper and orderly operation of the internal combustion engine is not possible even though there are no defects in the engine.

A further disadvantage of the noted construction resides in the fact that a pulse-shaped four phase alternating current is required to operate the stepping motor. To generate the pulse-shaped four phase alternating current, it is necessary to provide electronic circuitry which requires a considerable monetary expenditure to produce.

Yet a further disadvantage of the noted construction results from the use of the stepping motor since the stepping motor requires the production of an alternating current having very steep pulse flanks, unduly high interference radiation results emanating from the supply lines for the stepping motor, which interference is far above the permissible level.

While the use of short feed or supply lines could inhibit the generated interference, the use of short feed lines or supply lines can only be realized by arranging the stepping motor and associated electronic circuit in close proximity to each other. However, the arrangement of the stepping motor and electronic circuit in close proximity is disadvantageous since the electronic circuit is then subjected to thermal stress because the stepping motor with integrated electronic circuit attached to the fual injection pump is exposed to the intense heat radiated during the operation of the internal combustion engine. To compensate for the thermal stresses, the above-noted proposed construction is equipped with a liquid cooling unit.

Yet another disadvantage of the above-noted construction resides in the fact that two limit switches are required by means of which the stepping motor is stopped if the movable stop reaches one or the other final end positions.

The aim underlying the present invention essentially resides in providing a control device for a fuel injection pump of an internal combustion engine, which ensures that the displaceability of the control rod of the fuel injection pump is not impeded in the event of an electrical failure or disturbance in the electronic circuit.

According to advantageous features of the present invention, an axially movable core of an electromagnet cooperates, under slight pretensioning, with a free end face of the control rod of the fuel injection pump and an electronic circuit means processes the output signal of an inductive displacement pick-up for the control rod position and the signals defining the operating conditions of the internal combustion engine to a control variable effecting a metered activation of the electromagnet.

With the control device of the present invention, as long as the electromagnet is not excited, the core thereof follows the movements of the control rod of the injection pump without limiting the position thereof. Only upon an excitation of the electromagnet by way of the electronic circuit means is there a fixation of the instantaneous position of the core and/or also a shift of the core together with the control rod in a direction toward reducing the quantity of fuel conveyed by the fuel injection pump.

In accordance with further advantageous features of the present invention, the inductive displacement pick-up constantly detects an instantaneous position of the control rod and feeds an A.C. voltage signal with an amplitude defining the control rod position to a demodulator which forms therefrom a D.C. voltage signal equivalent to the respective amplitude. This D.C. voltage signal being compared in a difference amplifier with a desired value for the instantaneously permissible control rod position and the difference amplifier yields an output signal only if the D.C. voltage signal of the demodulator exceeds the desired value. The thus-determined difference is the input signal for a controller yielding a variable D.C. voltage signal corresponding to its characteristic at the output. This signal is converted in a modulator into a timed D.C. voltage of a constant amplitude but a variable pulse width and the output signal of the modulator, amplified in a power amplifier, excites the electromagnet 17.

According to the present invention, the output signal of the modulator is examined in a test circuit as to the maintanence of certain fixed limiting values for the pulse width repetition ratio and the test circuit yields an output signal blocking the final stage if an erroneous value has been determined.

Advantageously, in accordance with the present invention, the desired value respectively fed to the difference amplifier is formed from the measured influential variables of the internal combustion engine, which variables characterize the instantaneous operating condition of the engine.

By virtue of the constructional features of the present invention, a control device is provided, whereby, in case of a current failure or in case of distrubances in the electronic circuit, the movable core of the electromagnet assumes its inactive rest position, whereby the movability of the control rod is not impeded. Moreover, the electromagnet associated with the control device of the present invention additionally takes over the function of the so-called cutoff magnet required at an injection pump.

Furthermore, with the control device of the present invention, the electronic control circuit can be arranged separately from the electromagnet so that the electronic control circuit is not exposed to thermal stresses caused by the radiated heat of the internal combustion engine. Also, there are no problems relating to interference since, to excite the electromagnet, a pulse shape with shallow flanks is sufficient. Consequently, any interfering radiation of the supply or feed lines between the electronic circuit and the electromagnet is negligibly small.

Furthermore, with the construction of the control device in accordance with the present invention, considerable economic advantages are obtained by virtue of the use of an electromagnet rather than a stepping motor and associated electronic circuit.

Accordingly, it is an object of the present invention to provide a control device for a fuel injection pump of an internal combustion engine which avoids, by simple means, shortcomings and disadvantages encountered in the prior art.

Another object of the present invention resides in providing a control device for a fuel injection pump of an internal combustion engine which ensures a proper and orderly operation of the internal combustion engine even upon failure in a supply of current and/or defects in the electronic circuit thereof.

A still further object of the present invention resides in providing a fuel injection pump of an internal combustion engine which enables the electronic circuit to be protected from exposure to thermal stresses.

Yet another object of the present invention resides in providing a fuel injection pump for an internal combustion engine which functions realiably under all operating conditions of the internal combustion engine.

Another object of the present invention resides in providing a fuel injection pump for an internal combustion engine which minimizes the effect of electrical interferences.

A further object of the present invention resides in providing a control device for an internal combustion engine which is simple in construction and therefore relatively inexpensive to manufacture.

These and other objects, features, and advantages of the present invention will become more apparent when taken in connection with the accompanying drawing which shows, for the purposes of illustration only, one embodiment in accordance with the present invention, and wherein:

The single FIGURE is a schematic view of an internal combustion engine having a control device for a fuel injection pump in accordance with the present invention.

Referring now to the single FIGURE of the drawings, according to this FIGURE, an injection pump 12 is operatively associated with an internal combustion engine 11, with the power required by the internal combustion engine being adjusted by way of a correcting element 13 operated by operating personnel so as to displace a control rod 14 at the injection pump 12. A centrifugal speed governor 15 formed, for example, as a flyweight governor, is arranged at the injection pump 12 with the governor 15 acting on the control rod 14 and monitoring the maintenance of limiting speeds of the internal combustion engine. An elastic member 30 is inserted in the transmission path between the correcting element 13 and the centrifugal speed governor 15, respectively, and the control rod 14 of the injection pump 12.

An electromagnet 17 is provided which includes an axially movable core 18 which cooperates, under a slight pretensioning by a spring 19, with a free end 16 of the control rod 14. When the electromagnet 17 is not excited, the core 18 follows the movements of the control rod 14. The respective positions of the control rod 14 are detected by an inductive displacement pickup 20 of conventional construction. Depending on the position of the control rod 14, the inductive displacement pickup 20 produces a characteristic output signal. During this step, an A.C. voltage signal of constant amplitude is supplied by an oscillator 21 and is converted in the inductive displacement pickup 20 into an A.C. voltage signal having an amplitude defining the position of the control rod 14.

Thereafter, a D.C. voltage signal equivalent to the respective amplitude is produced from this output signal of the inductive displacement pickup 20 in a demodulator 22. This D.C. voltage signal is compared in a difference amplifier 23 with a desired D.C voltage 31 for the presently proper position of the control rod 14. However, an output signal from the difference amplifier 23 results or is further processed only when the D.C. voltage signal from the demodulator 22 exceeds the specific D.C. voltage 31. The thus-determined difference represents an input signal for a regulator or controller 24, e.g., a proportional integral regulator (P.I. Regulator), which provides, as an output signal, a variable D.C. voltage signal corresponding to its characteristic, which signal is converted in a modulator 25 into a timed D.C. voltage of constant amplitude with a variable pulse width repetition ratio.

The output signal from the modulator 25, further amplified in a power amplifier 26 such as, for example, a two-stage transistor amplifier energizes the electromagnet 17. Depending on the magnitude of the output signal of the difference amplifier 23, the electromagnet 17 is excited to such an extent that either the core 18 is retained in its instantaneous position or there is a displacement of the core 18 and control rod 14 into a position for a reduced fuel feed by the injection pump 12. The respective instantaneous position of the correcting element 13 and the centrifugal speed governor 15 is not affected by the displacement of the control rod 14 by the core 18 because the displacement of the control rod 14 caused by the electromagnet 17 is absorbed by the elastic member 30.

The output signal of the modulator 25 is also fed to a test circuit 27, of conventional construction, wherein the pulse width of the timed D.C. voltage is tested for plausibility. A pulse width repetition ratio higher than 50% causes an energizing of the electromagnet 17 to the effect that the control rod 14 is displaced into a position for stopping the engine 11. However, this procedure may only take place if a corresponding motor shutoff signal is also present.

The test circuit 27 includes, for example, a RC member with a downstream threshold switch. The time constant of the RC member is so selected that the capacitor of the RC member is only charged up to a predetermined voltage value by the timed D.C. voltage with the correct pulse width. With greater pulse width a voltage on the capacitor is higher than the predetermined voltage, whereby the threshold switch responds and the power amplifier is blocked and energizing of the electromagnet 17 is interrupted. Thus, if an erroneous signal results in the test circuit 27, a corresponding output signal 28 blocks the power amplifier 26 and thus the excitation of the electromagnet 17 is interrupted. The core 18 is then no longer activated so that the control rod 14 can follow, without hinderance, the correcting movements initiated by the correcting element 13 and/or the centrifugal speed governor 15.

The desired value formation for the difference amplifier 23 takes place in a circuit member 29 on the basis of influential actuating variables measured at the internal combustion engine 11, which variables characterize the instantaneous operating condition of the engine 11.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A control arrangement for a fuel injection pump of an internal combustion engine, the control arrangement including a control rod means for adjusting a required feed rate of the injection pump, a correcting means for determining a required power of the internal combustion engine, a centrifugal governor means for maintaining limiting speeds of the internal combustion engine, the correcting means and centrifugal governor means being operatively effective on the control rod means for adjusting a required feed rate of the injection pump, and means for limiting a displacement of the control rod means in dependence upon at least one predetermined variable of the internal combustion engine, characterized in that the limiting means includes an electromagnetic means having a core adapted to cooperate with a free end of the control rod means, means are provided for sensing a position of the control rod means and for providing an output signal indicative of the sensed position, and in that electronic circuit means are provided for processing the output signal of said sensing means at least one signal defining an operating condition of the internal combustion engine and for effecting a metered activation of the electromagnet.

2. A control arrangement according to claim 1, characterized in that said sensing means includes an inductive displacement pickup means operatively associated with the control rod means.

3. A control arrangement according to claim 2, characterized in that the core is mounted so as to be axially movable, and in that means are provided for supplying a slight pretensioning to the core.

4. A control arrangement according to one of claims 2 or 3, characterized in that the inductive displacement pickup means constantly detects an instantaneous position of the control rod means and provides an A.C. voltage signal having an amplitude defining the instantaneous position of the control rod means, the electronic circuit means includes a demodulator means for receiving the A.C. voltage signal of the inductive displacement pickup means and for providing a D.C. voltage signal equivalent to the respective amplitudes, a difference amplifier means for receiving the D.C. voltage signal from the demodulator means and comparing the received signal with a signal corresponding to a desired value for the sensed instantaneous position of the control rod means and for providing an output signal only if the signal of the demodulator means exceeds the desired value, a controller means for receiving an output signal from the difference amplifier means and for providing a variable D.C. voltage output signal, and a modulator means for coverting the variable D.C. voltage output signal from the controller means into a timed D.C. voltage of constant amplitude but with a variable pulse width, the modulator means is operatively connected with the electromagnetic means so that an output signal from the modulator means activates the electromagnet means.

5. A control arrangement according to claim 4, characterized in that means are interposed between the modulator means and the electromagnetic means for amplifying the output signal from the modulator means.

6. A control arrangement according to claim 5, characterized in that the electronic circuit means further includes a test circuit means for examining the output signal of the modulator means so as to determine a maintenance of certain fixed limiting values for the pulse width and for providing a blocking output signal to the amplifying means if the output signal of the modulator means is below the limiting values.

7. A control arrangement according to claim 6, characterized in that means are provided for measuring variables corresponding to the instantaneous operating condition of the internal combustion engine and for feeding signals corresponding to the variables to the comparator means, and in that the desired value in the difference amplifier means is formed from at least one of the measured variables.

8. A control arrangement according to claim 6, characterized in that means are arranged between the correcting means, centrifugal governor means, and control rod means for enabling the control rod means to be displaced in a fuel reduction direction without affecting a positioning of the correcting means and the centrifugal governor means.

* * * * *